United States Patent [19]

Thorne

[11] Patent Number: 4,510,633

[45] Date of Patent: Apr. 16, 1985

[54] INVALID TRANSFER MEANS

[76] Inventor: Mark W. Thorne, 3216-6 Stonesthrow La., Durham, N.C. 27713

[21] Appl. No.: 432,332

[22] Filed: Dec. 20, 1982

[51] Int. Cl.[3] ..... A61G 7/08

[52] U.S. Cl. ..... 5/81 R; 5/86; 5/89; 297/DIG. 4; 297/437; 297/345

[58] Field of Search ..... 5/81 R, 81.3, 83–89; 297/DIG. 10, DIG. 4, 437, 423, 195, 345; 294/140; 414/921; 280/47.13 R, 47.17, 47.25, 47.38, 43.1, 87.04 R, 87.05, 647, 650

[56] References Cited

U.S. PATENT DOCUMENTS

| | | | |
|---|---|---|---|
| 2,708,119 | 5/1955 | Best | 280/43.1 |
| 2,890,740 | 6/1959 | Larson | 297/345 |
| 3,137,011 | 6/1964 | Fischer | 5/86 |
| 3,394,933 | 7/1968 | Benoit | 5/81 R |
| 3,625,563 | 12/1971 | Dickinson et al. | 297/345 |
| 3,738,600 | 6/1973 | Harper | 280/47.25 |
| 3,823,169 | 11/1971 | James | 5/86 |
| 3,829,916 | 8/1974 | James | 5/86 |
| 4,238,097 | 12/1980 | Clausen et al. | 297/345 |

FOREIGN PATENT DOCUMENTS

| | | | |
|---|---|---|---|
| 864443 | 1/1953 | Fed. Rep. of Germany | 280/650 |
| 2472498 | 7/1981 | France | 280/47.13 R |

*Primary Examiner*—Alexander Grosz
*Assistant Examiner*—Michael F. Trettel
*Attorney, Agent, or Firm*—Mills & Coats

[57] ABSTRACT

In abstract a preferred embodiment of this invention is a transfer means for moving incapacitated or partially incapacitated patients or persons from one location to another. A single nurse or orderly can place the patient on the device and move such patient without assistance and without exerting excessive effort and without requiring a great amount of strength. This is accomplished through a counterbalanced arrangement which allows the weight of the patient to be disposed near the center of gravity of the device for easy pivoting and manipulation during the loading, moving and unloading sequence.

13 Claims, 5 Drawing Figures

INVALID TRANSFER MEANS

FIELD OF INVENTION

This invention relates to medical appliances and more particularly to means for moving incapacitated and partially incapacitated persons from one location to another.

BACKGROUND OF INVENTION

Since man first began to care for his weak and infirm brethern, the problem of moving such people from one location to another, whether for their pleasure or for necessity, has been of concern. The age old method of having two aids, orderlies, or other persons with adequate strength to support the person being moved continues to be the most universal method. Due to the expense of having assistants available is becoming more and more prohibitive from a cost standpoint.

Lifts of various types have been devised for transferring and moving incapacitated and partially incapacitated persons including large contraptions with arms and sling-like members which are raised and lowered by either hydraulic, electrical or mechanical means. These systems almost invariably are large and awkward, require at least two persons to operate, and are extremely expensive to buy.

Another problem encountered is even the simple chores such as moving a patient from a bed to a chair can involve a considerable amount of work and staff time and yet does not justify the use of presently known mechanical transfer means.

BRIEF DESCRIPTION OF INVENTION

After much research and study into the above-mentioned problems, the present invention has been developed to provide a relatively inexpensive and yet highly efficient transfer means for incapacitated and partially incapacitated persons which can be readily connected and disconnected to the user thereof, can be manipulated by a single assistant both in the loading, unloading and transport processes, and does not require a great deal of strength to manipulate.

The above is accomplished through the use of a unique strap system for connection to the person to be moved along with a simple and yet highly efficient pivotable frame which allows the person being transported to be rotated to a point above the center of gravity in a counterbalanced fashion which is maintained during the transport part of the moving process.

In view of the above, it is an object of the present invention to provide a relatively inexpensive and yet highly efficient means for moving incapacitated and partially incapacitated persons from one place to another.

Another object of the present invention is to provide a moving means for incapacitated and partially incapacitated persons which can be secured to and unsecured from the person as well as manipulated during the moving process by a single assistant of nominal strength and statute.

Another object of the present invention is to provide a patient moving means wherein a single nurse or orderly can handle the entire process of transferring said patient from one point to another as for example from a bed to a chair or bathroom.

Another object of the present invention is to provide a patient moving means which is inexpensive to purchase and yet is highly efficient in operation.

Another object of the present invention is to provide a moving means for incapacitated or partially incapacitated persons which can be readily stored in a small area or space when not in use.

Another object of the present invention is to provide a small, compact, relatively lightweight patient transfer means which is uncomplicated to use and can be readily manipulated by a single assistant.

Other objects and advantages of the present invention will become apparent and obvious from a study of the following description and the accompanying drawings which are merely illustrative of the present invention.

DETAILED DESCRIPTION OF INVENTION

Figure 2:
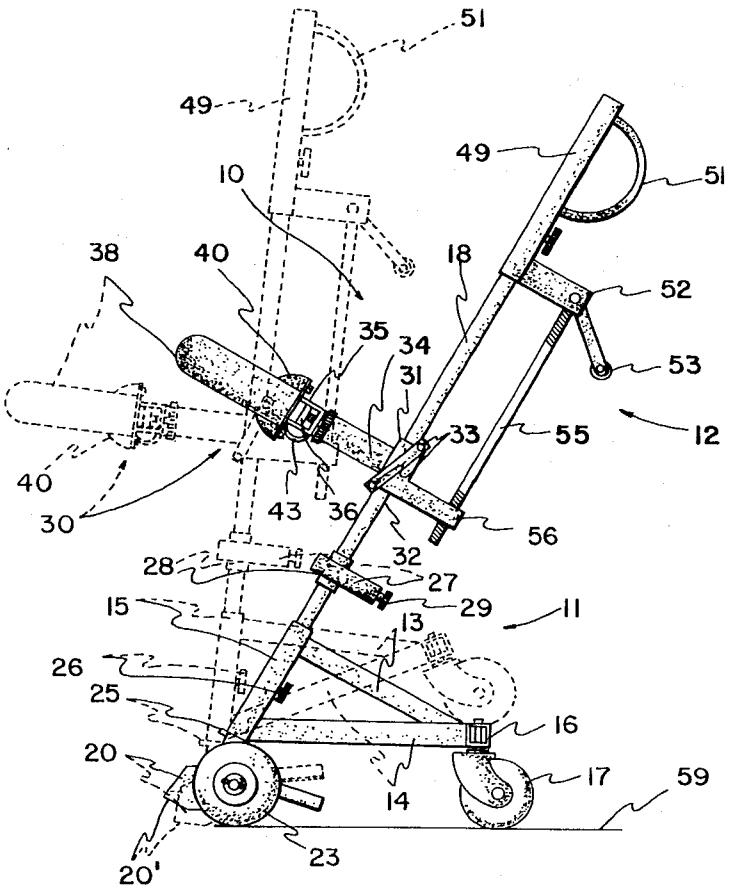
FIG. 2 is a side elevational view illustrating the tipping portion of the present invention.

With further reference to the drawings, the invalid transfer means of the present invention, indicated generally at 10, includes a carriage portion, indicated generally at 11 and an invalid attaching and lift portion, indicated generally at 12.

Referring more specifically to the carriage portion 11, a frame in the form of an inverted right triangle is composed of brace member 13, spanner member 14 and slide member 15. These various members are interconnected by weldment or other suitable means.

At the juncture of brace member 13 and spanner member 14 is secured, again by weldment or similar means, caster wheel support frame 16. This support frame has mounted on either end thereof caster wheels indicated at 17. Since caster wheels of this type, their mountings and operation are well known to those skilled in the art, further detailed description of the same is not deemed necessary.

Figure 4:
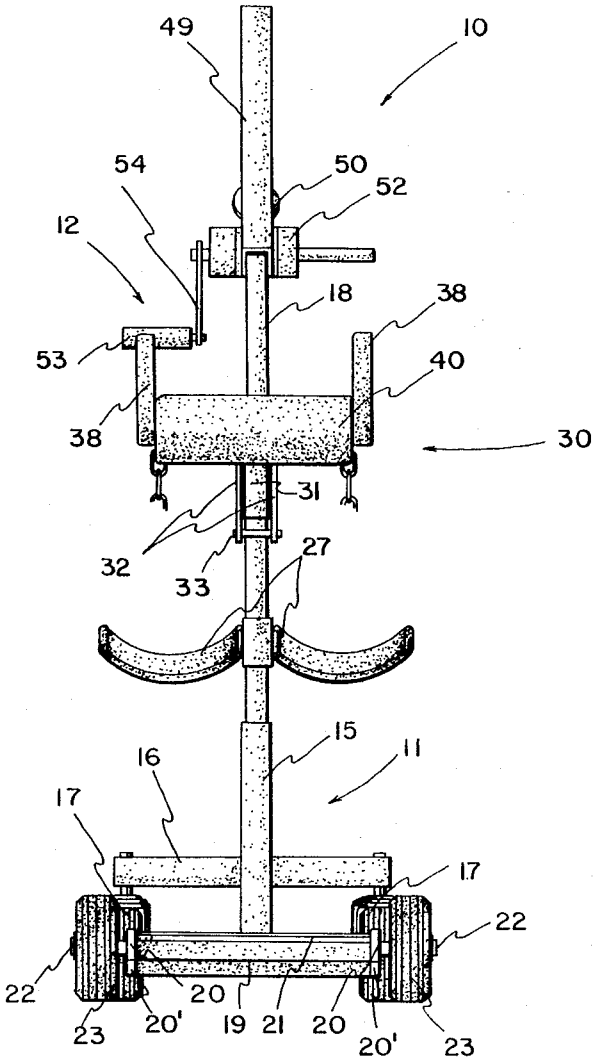
FIG. 4 is a front elevational view thereof.

Referring now more specifically to the invalid attaching and lift portion 12 of the present invention, a main support column 18 is provided which is preferably fabricated from channel iron type material. To the lower portion of this main support column is secured by weldment or other means, a cross member 19 as can clearly be seen in FIGS. 1 and 4. End plates 20 are secured to each end of cross member 19 by weldment or similar means.

Disposed between end plates 20 and secured thereto, again by weldment, is a footrest plate 21.

Welded to the outer side of each of the end plates 20 is an outwardly projecting axle 22 on which is rotatively mounted support wheels 23. Means such as pins 24 are used to secure the wheels 23 on axle 22 in the normal manner of such devices.

A stop 25 is provided on main support column 18. When slide member 15 of carriage portion 11 is placed thereon, the slide 18 will engage stop 25 and, therefore, proper relationship of the two parts is assured. A set knob 26 is threaded through the side wall of slide member 15 and lockingly engages support column 18 in the normal manner of set screw type means.

Adjustably mounted above slide member 15 of carriage portion 11 on column 18 is a pair of knee supports 27 fixedly secured to opposite sides of slide 28. An elongated set knob 29 is threaded through one side of slide 28 and releasably secures said slide on column 18.

A body support, indicated generally at 30, includes a slide 31 mounted for longitudinal movement up and down support column 18. On opposite sides of this slide 31 is fixedly secured a roller bracket 32. Extending between the ends of each of these brackets is a roller means 33. The purpose of these rollers is to allow slide 31 to move upwardly and downwardly along support column 18 with minimum friction even though great weight may be carried by the body support 30.

Outwardly extending from slide 31 is arm members 34 which has a box beam type cross member 35 welded or otherwise secured to its outer end. An intermediate interior plate 36 runs the length of cross member 35 and is fixedly secured thereto. The elongated ear portion 37 of arm support 38 is generally flat in structure and is adapted to slide into the slot-like opening formed between plate 36 and the outer edge of cross member 35. A set knob 39 is threaded through one side of cross member 35 and through internal plate 36 to releasably secure the arm support 38 relative to said cross member 35. Thus it can be seen that the ear portion 37 can be slid inwardly or outwardly at opposite ends of cross member 35 to adjust for varying sized persons using the transfer means of the present invention. Once proper adjustment has been made, this can be secured by manipulation of said knob 39 in the normal manner of such devices.

The arm supports 38 are, of course, padded as is chest pad 40. This pad is secured to cross member 35 by means such as brackets 41 and bolts 32. Foam rubber or any other suitable material can be used to make chest pad 40 comfortable for the user of the means of the present invention.

To each end of cross member 35 is provided a bail loop 43. This bail loop is adapted to have secured thereto by snap hooks 44 or other suitable means, a back engaging safety strap 45.

Also releasably secured to cross member 35 by way of bails 43 is flexible fabric seat means 46. This seat means includes on each side a strap portion 47, a snap hook 48 or similar securing means and a length adjusting means which can be either a chain, strap, or the like. Since length adjustable supports are well known to those skilled in the art, further detailed discussion of this feature of the present invention is not deemed necessary.

An upper slide 49 is adjusted longitudinally up and down support column 18 and is locked in place by set knob 50 which is threaded through one wall of said last mentioned slide. A handle 51 is fixedly secured to slide 49 for aiding in the manipulation of the invalid transfer means 10 of the present invention.

A life means such as a gear box 52 is fixedly secured to the lower portion of slide 49 and is adapted to transfer rotary movement about a horizontal axis created by handle 53 and handle arm 54 to a vertical rotary movement in worm gear 55. Since the operation of crank handles, gear boxes and worm gears are well known to those skilled in the art, further detailed discussion of the same thereof is not deemed necessary.

The end of worm gear 55 opposite gear box 52 is threaded through gear block 56 which in turn is fixedly secured to slide 31. Thus it can be seen that with slide 49 fixed by set knob 52 to column 18, as crank handle 53 is turned in one direction, worm gear 55 will move slide 31 and its associated structure upwardly along column 18 and when such handle is cranked in the opposite direction, said slide will be moved downwardly thereby assuring proper adjustment to the particular patient or person using the transfer means of the present invention.

To assemble the transfer means of the present invention, column 18 is inserted through slide member 15 and moved down to stop 25. Set knob 26 is then manipulated to secure such member to such column. Next, slide 28 is placed on column 18 and moved to the approximate use position and set knob 29 is used to secure slide 28 on said column. Next, slide 31 of attaching and lift portion 12 is slipped over column 18 and moved downwardly until upper slide 49 can also be placed on column 18. Set knob 50 is then screwed in to engage the column and to lock slide 49 relative thereto. The transfer means of the present means is now ready for use.

Figure 1:
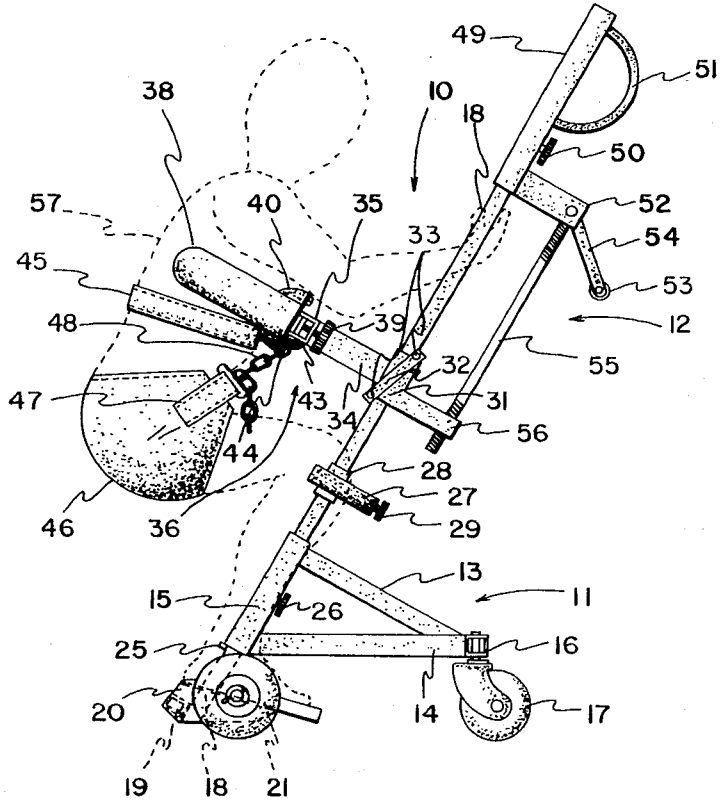
FIG. 1 is a side elevational view of the invalid transfer means showing a person connected thereto.
Figure 3:
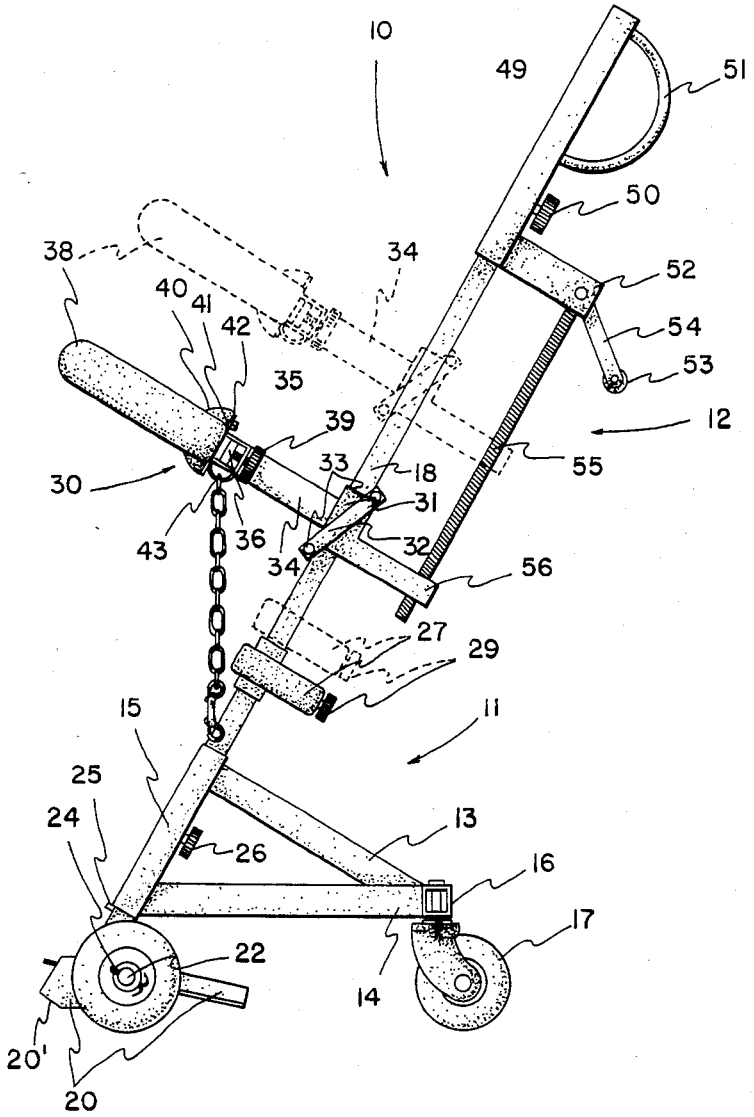
FIG. 3 is a side elevational view showing the lift portion of the present invention.
Figure 5:
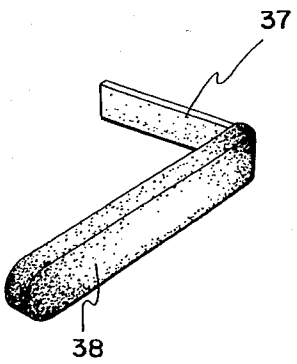
FIG. 5 is a perspective view of the arm support means.

By way of illustration, if the invalid or other person 57 is lying on a bed 58 or other surface, the transfer means 10 of the present invention is rolled up adjacent thereto as illustrated in FIG. 2. It is then tipped up until column 18 is in a near vertical position and the heels 20' of plates 20 engage the floor 59 to steady the transfer means. The patient, invalid or other person to be lifted is placed in a sitting position and his or her feet are placed on footrest 21. Set knob 29 is released to allow knee supports 27 to be moved upwardly or downwardly on column 18 to the appropriate position as illustrated in FIG. 1. The set knob is then used to again lock slide 28 to said column. The fabric or flexible seat means 46 is then passed under the buttocks of the patient 57 and after the appropriate length adjustment has been made, it is connected to body support means 30. Handle 53 is then manipulated to either raise or lower slide 31 until arm supports 38 are under the arm pits of the patient 57. Because of the nature of worm gears, further locking of this position is not necessary.

Set knobs 39 are then loosened and arm supports 38 moved inwardly or outwardly so as to be just snug against the sides of the body of the patient 57. Set knob 39 are then again locked. Next, appropriate length adjustment is made in strap 45 and it is snapped onto bails 43 as illustrated in FIG. 1. The person to be transferred is still sitting on surface 58 but is now ready to be moved.

The nurse, orderly or other person transferring the patient 57 simply pulls back on handle 51 which pivots the patient (now firmly secured to the transfer means 10) over until caster wheels 17 engage the floor or other surface 59. The center of gravity of the patient is now over the carriage 11 and the patient can be rolled to any desired location.

Once moved to such location, the transfer means 10 of the present invention is tipped up to the position shown in dotted lines in FIG. 2 with heels 20' of plates 20 engaging surface 59. Handle 53 is then manipulated as necessary to lower the patient to surface 58 where strap 45 and seat 46 can be removed. The transfer means 10 is then moved back away from the patient 57, placed back in the position shown in solid lines in the Figures, and can remain in such position until it is ready to use again.

If the patient 57 is simply using the transfer means of the present invention to go to the bathroom, once he is sitting on the toilet, the seat 46 can simply be removed and once the excretion has been completed, the same can be replaced and the patient moved back to his bed, chair or other area. The advantage of this, of course, is that release of the strap 45 and readjustment of the arm supports and other parts of the transfer means is not necessary and the entire transfer to and from the bathroom can be very quickly and easily accomplished.

If, of course, the patient is to be transported for a short distance such as from a bed to the bathroom, only the arm supports or the arm supports and back strap are necessary. On the other hand, if the seat or buttock support is used, the arm supports and back strap are not necessary unless, of course, the patient has a physical condition which requires the same.

From the above it is obvious that the present invention has the advantage of providing a relatively inexpensive and yet highly efficient invalid transfer means which can be completely and safely operated by a single attendant or orderly and which does not require any special training or expertise to use. The aid or orderly does not have to be a person of large statute or great strength to manipulate the means of the present invention but to the contrary, a small, petite person can handle large, heavy patients with ease.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A transfer means for invalid type persons comprising: a carriage means; lever means connected to and extending above said carriage means and movable between an initial inclined transport position in which said lever means extends over the center of gravity of said carriage means and a generally vertical loading position; means adjustably mounted on said lever means for supporting said person from both the posterior and anterior of the person's body; and means for tilting said lever means and its supported person between said loading position and said transport position in which said person is disposed generally above the center of gravity of said carriage means whereby a relatively simple and yet highly efficient device for moving invalid type persons is provided.

2. The means of claim 1 wherein said carriage is wheel supported.

3. The means of claim 2 including at least one caster type wheel.

4. The means of claim 1 wherein said means for supporting said person includes means for adjustably moving the same relative to said lever means.

5. The means of claim 4 wherein said moving means is a worm gear type mechanism.

6. The means of claim 1 including a seat means releasably connected to said means for supporting said person.

7. The means of claim 1 including means adjustably connected to said means for supporting said person for engaging the arms of said person.

8. The means of claim 1 including a back strap means releasably connected to said means for supporting said person.

9. A transfer means for invalid type persons comprising: a carriage means; lever means connected to and extending above said carriage means and movable between an initial inclined transport position in which said lever means extends over the center of gravity of said carriage means and a generally vertical loading position; support means associated with said transport means for supporting said person from both the posterior and anterior of the person's body, said support means including a pair of foot supports secured to the lower end of said lever means, a pair of knee supports adjustably mounted on an intermediate portion of said lever means, an upper body support adjustably mounted on said lever means above said knee supports, a seat support removably secured to said transfer means for supporting the person's buttocks, and a back support removably secured to said transfer means for supporting the back of the person; and means for tilting said transfer means and the person secured thereto between said loading position and said transport position whereby said knee supports act as a fulcrum when the person's buttocks is lifted from or lowered to a surface.

10. The means of claim 9 wherein said upper body support includes a cross member for supporting the person's chest and a pair of arm members extending outwardly from opposite ends of said cross member on either side of the person.

11. The means of claim 10 wherein said arm members are adjustable to move inward and outeard with respect to said cross member such that said arm members can be adjusted to fit snugly against either side of the supported person.

12. The means of claim 9 wherein said seat support and said back support include strap type support means for extending around the person's body and are removably secured to said upper body support of said transfer means.

13. The means of claim 9 wherein said upper body support is operatively connected to a worm-gear type mechanism for moving said upper body support up and down on said lever means.

* * * * *